US006239674B1

(12) United States Patent
Enokihara et al.

(10) Patent No.: US 6,239,674 B1
(45) **Date of Patent: *May 29, 2001**

(54) ELLIPTICAL RESONATOR WITH AN INPUT/OUTPUT CAPACITIVE GAP

(75) Inventors: Akira Enokihara, Nara; Kentaro Setsune, Sakai, both of (JP)

(73) Assignee: Matsushita Electric Industrial Co., Ltd, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/360,362

(22) Filed: Dec. 21, 1994

(30) Foreign Application Priority Data

Dec. 27, 1993 (JP) ..... 5-330922
May 24, 1994 (JP) ..... 6-109385

(51) Int. Cl.[7] ..... H01P 1/203

(52) U.S. Cl. ..... 333/204; 333/219

(58) Field of Search ..... 333/204, 205, 333/219, 235, 185

(56) References Cited

U.S. PATENT DOCUMENTS

| | | | | |
|---|---|---|---|---|
| 3,639,857 | * | 2/1972 | Ohoshi et al. | 333/238 |
| 4,583,064 | * | 4/1986 | Makimoto et al. | 333/219 |
| 4,992,763 | * | 2/1991 | Bert et al. | 333/219 |
| 5,172,084 | * | 12/1992 | Fiedziuszko | 333/204 |
| 5,369,383 | * | 11/1994 | Takahashi et al. | 333/219 |
| 5,400,002 | * | 3/1995 | Takahashi et al. | 333/219 |

FOREIGN PATENT DOCUMENTS

| | | | |
|---|---|---|---|
| 0001306 | * | 1/1989 | (EP) . |
| 0516440 | | 12/1992 | (EP) . |
| 56-141605 | | 5/1981 | (JP) . |
| 0001304 | * | 1/1989 | (JP) . |
| 0001305 | * | 1/1989 | (JP) . |
| 1688316 | * | 10/1991 | (SU) . |

OTHER PUBLICATIONS

Watkins, J.; "Circular Resonant Structures in Microstrip", *Electronics Letters*, vol. 5, No. 21, (Oct. 16, 1969); p. 524–525.

Curtis, J.A. et al; "Multi–Layered Planar Filters Based on Aperture Coupled, Dual Mode Microstrip or Stripline Resonants"; *1992 IEEE MIT–S Digest* (1992); p. 1203–1206.

Schrank, H., "Antenna Designer's Notebook," IEEE Antennas and Propagation Magazine, vol. 32, No. 5, Oct. 1990, New York, pp. 45–46.

Weinschel et al., "A Medium–Gain Circularly Polarized Macrostrip UHF Antenna for Marine DCP Communication to the GOES Satellite System," Internat'l Antenna and Propagation Symposium, Oct. 1976, Amherst, pp. 391–394 European Search Report dated May 31, 1996.

* cited by examiner

*Primary Examiner*—Justin P. Bettendorf
*Assistant Examiner*—Stephen E. Jones
(74) *Attorney, Agent, or Firm*—Morrison & Foerster LLP

(57) ABSTRACT

A resonator having high Q-value has a compact structure with little loss caused by the conductor's resistance. The resonator includes a high-frequency circuit element.

Two points on the circumference of the conductor of elliptical shape which forms the resonator at which both of the two dipole modes of the resonant modes of the resonator polarizing orthogonally are excited equally and are located at neighboring positions input/output bonding points. The input/output terminals are bonded to the resonator at the input/output bonding points.

20 Claims, 14 Drawing Sheets

ELLIPTICAL RESONATOR WITH AN INPUT/OUTPUT CAPACITIVE GAP

BACKGROUND OF THE INVENTION

1. Field of the Invention

The present invention relates to a high-frequency circuit element comprising resonators such as a filter or a branching filter for use in high-frequency signal processing devices used in communication systems.

2. Description of the Related Art

High-frequency circuit elements comprising resonators such as a filter, or a duplexer are essential in the field of high-frequency communication systems. In particular, the field of mobile communication systems requires a filter with a narrow bandwidth to efficiently use a frequency band. Further, in a base station for mobile communications or a communication satellite, a filter having a narrow band range, little loss, compact size and durability against a large electric power is desirable .

Conventional high-frequency circuit resonant filters comprise dielectric resonators, transmission line resonators, or surface acoustic wave elements. Conventional resonant filters comprising transmission line resonators are most widely used since they are compact, applicable to a high frequency as far as microwaves or milliwaves, and easily combined with the other circuits or elements to form a two-dimensional structure on a substrate. An example of a conventional resonant filter comprising a transmission line structure is a half-wavelength resonator which is most widely used. By connecting half-wavelength resonators plurally, high-frequency circuit elements such as filters can be formed ("Shokai Reidai Enshu Microwave Circuit" published by Tokyo Denki Daigaku Shuppankyoku).

Another conventional example is a resonant filter having a planar circuit structure. A typical example of a resonant filter having a planar circuit structure is one comprising a round planar resonator having a partially protruding portion at its circumference to couple dipole modes to display a filter characteristic (Institute of Electronics and Communication Engineers of Japan's article collection 72/8 Vol.55-B No.8 "Analysis of Microwave Planar Circuit" written by Tanroku MIYOSHI and Takanori OKOSHI).

However, resonators with a transmission line structure, such as half-wavelength resonators, have problems since high-frequency current tends to concentrate within the conductor to considerably increase resistance loss therein, which leads to the deterioration of the Q-value when used in a resonator or the increased loss when used in a filter. A half-wavelength resonator commonly used with a microstrip line structure has a disadvantage of radiation loss from the circuit.

Further, a resonator with a planar circuit structure comprising a round planar resonator with a protruding portion has electric current concentration in the protruding portion, and the discontinued structure at the protruding portion causes signal waves radiation to space, which will lead to the deterioration of the Q-value of the resonator, and the increased loss in this type of filter.

Such effects become more conspicuous if the structure is minimized or the operating frequency becomes higher. As a resonator of a comparatively little loss and good power handling capacity, dielectric resonators are used but the solid structure and bulkiness prohibits reducing the size of the high-frequency circuit elements.

Use of a superconductor can reduce the loss of such high-frequency circuit elements. However, in the above-mentioned conventional structures, superconductivity cannot be sustained in the above-mentioned conventional structure of a resonator due to the excessive concentration of the electric current. Therefore, it is difficult to use a signal of a large power. In the virtual measuring, the maximum input power is lower than 100 mW which is below a practical level.

With reference to the above-mentioned problems, obviously it is essential to solve such problems of resonators of a transmission line structure or a plane circuit structure to obtain a high-frequency circuit element including a resonant filter which has a compact and two-dimensional structure, matches other circuits or elements well, and performs excellently when applied to high-frequencies, such as microwaves or milliwaves.

SUMMARY OF THE INVENTION

The present invention provides a resonator with little loss caused by conductor resistance, a high Q-value in a compact structure. The present invention also provides a high-frequency circuit element of an excellent quality comprising the resonator in order to solve the above-mentioned conventional problems.

A first example of the resonator of this invention comprises a conductor formed on a substrate. The conductor has two fundamental dipole modes polarizing orthogonally to each other as the resonant modes and there is no degeneration therein.

It is preferable that the conductor has a smooth outline.

It is preferable that the resonator comprises a conductor formed on a substrate having an elliptical shape.

In the first example of the resonator, it is preferable to have a structure selected from the group consisting of a microstrip line structure, a strip line structure, and a coplaner wave guide structure. It is further preferable to form a grounding electrode on the substrate in the vicinity of the conductor in the structure.

In the first example of the resonator, it is preferable to have a plate-type conductor placed between two grounded planes which are located in parallel.

In the first embodiment of the resonator, it is preferable to have a slit in the conductor. It is further preferable to orient the slit perpendicular to the current direction of a resonant mode.

A first example of the high-frequency circuit element of the present invention has a resonator comprised of a conductor formed on a substrate which has two dipole modes polarizing orthogonally without degeneration as the resonant modes, and at least one input/output terminal bonds to the resonator at a point on the circumference of the conductor comprising the resonator.

Moreover, in the first example of the high-frequency circuit element, it is preferable that two points on the circumference of the conductor comprising the resonator at which only one of the two dipole modes of the resonant modes of the resonator polarizing orthogonally is excited are the input/output bonding points 1, 2. The input/output terminals are bonded to the resonator at the input/output bonding points 1, 2.

Further, in the first example of the high-frequency circuit element, it is preferable that two points on the circumference of the conductor comprising the resonator at which only one of the two dipole modes of the resonant modes of the resonator polarizing orthogonally is excited are the input/output bonding points 1, 2 and two other points at which only the other one of the two dipole modes is excited are the input/output bonding points 3, 4. The input/output terminals are bonded to the resonator at the input/output bonding points 1–4.

In the first example of the high-frequency circuit element, it is preferable that two points on the circumference of the conductor comprising the resonator at which both of the two dipole modes of the resonant modes of the resonator polarizing orthogonally are equally excited and are located at neighboring positions are the input/output bonding points 1, 2. The input/output terminals are bonded to the resonator at the input/output bonding points 1, 2.

In the first example of the high-frequency circuit element, it is preferable that two points on the circumference of the conductor comprising the resonator at which both of the dipole modes of the resonant modes of the resonator polarizing orthogonally are equally excited and are located opposite each other are the input/output bonding points 1, 2. The input/output terminals are bonded to the resonator at the input/output bonding points 1, 2.

In the first example of the high-frequency circuit element, it is preferable that on the circumference of the conductor comprising the resonator, there is a point at which both of the dipole modes of the resonant modes of the resonator are equally excited is the input/output bonding point 1, a point at which only one of the dipole modes is excited is the input/output bonding point 2, and a point at which only the other one of the dipole modes is excited is the input/output bonding point 3. The input/output terminals are bonded to the resonator at the input/output bonding points 1–3.

A second example of the high-frequency circuit element of the present invention has a plurality of resonators, each of the resonators are comprised of a conductor formed on a substrate. Each conductor has two dipole modes polarizing orthogonally without degeneration as the resonant modes. The resonators are bonded to each other.

In the second example of the high-frequency circuit element, it is preferable that two points at which both of the dipole modes orthogonally polarizing of the resonant modes of each resonator are equally excited and are located at neighboring positions are the input/output bonding points 1, 2. A plurality of resonators are bonded in series at the input/output bonding points 1, 2 and at the bonding points of the resonators located at the ends of the plurality of resonators, and are not bonded to the neighboring resonator. The input/output terminals are bonded to the resonators at the ends.

In the above-mentioned structures of the high-frequency circuit element, it is preferable that the input/output terminals comprise transmission lines. One end of a transmission line is coupled with the conductor comprising the resonator by capacitance or inductance. It is preferable that the ends of the transmission lines are coupled by capacitance by forming a gap between the end of the transmission line and the circumference of the conductor comprising the resonator with a gap portion therebetween, and it is further preferable that the edges of the transmission lines are widened.

Moreover, in the structures of a resonator or a high-frequency circuit element, it is preferable to use a superconductor as the conductor material.

In the first example of the resonator of the present invention, since the structure comprises a conductor formed on a substrate having two dipole modes orthogonally polarizing without degeneration as the resonant modes, a single resonator can provide the function of two resonators of different resonant frequencies by using the two modes individually. It contributes to enable the efficient use of the resonator's circuit area in order to reduce the size of the resonator.

In an embodiment of the resonator of the present invention, since the conductor has a smooth outline, decline in the Q-value caused by the radiation loss increase can be curbed because it can avoid the excessive concentration of the high-frequency electric current to radiate the signal waves into space, subsequently accomplishing a high Q (unloaded Q). Moreover, since the high-frequency electric current spreads two-dimensionally to curb the maximum current density when the resonant operation is conducted with a high-frequency signal of the same electric power, the structure prevents problems caused by the excessive concentration of high-frequency electric current such as deterioration of the conductor material by heat even when applied for a high-frequency signal of a large electric power. Consequently a high-frequency signal of a larger electric power is possible.

In an embodiment of the resonator of the present invention, since the conductor formed on a substrate comprises an elliptical shape, a resonator having the dipole modes orthogonally polarizing without degeneration as the resonant modes can easily be accomplished.

In the first example of the resonator of the present invention comprising a structure selected from the group consisting of a microstrip line structure, a strip line structure, and a coplaner wave guide structure, the following advantages can be provided. That is, a microstrip line structure has a simple structure and matches with other circuits well. A strip line structure has very little radiation loss to provide a high-frequency circuit element with a little loss. A coplaner wave guide structure includes the ground plane at one side of the substrate to simplify the production process. It is especially useful when a high-temperature superconducting thin film is used as the conductor material since it is difficult to form the thin film on both sides of the substrate. In this case, in a preferable embodiment of the structure having a grounding electrode at the circumference of the conductor on the substrate, it is highly effective since it prevents unstable operation caused by leakage of the electromagnetic waves.

In an embodiment of the resonator of the present invention comprising a plate-type conductor placed between the two grounded planes located in parallel, since air (or a vacuum or a gas) i.e., a material with a low relative dielectric constant surrounds the conductor, the characteristic impedance of the resonator increases and the high-frequency current in the conductor decreases to reduce the loss in the resonator.

In an embodiment of the resonator of the present invention having a slit in the conductor, since the resonant frequency of the two resonant modes can be changed by adjusting the orientation or the length of the slit, the resonant frequencies of the two resonant modes can be finely adjusted by forming a slit after the completion of the resonator, or by extending the length of the slit already equipped. It is preferable to orient the slit perpendicular to the current direction so that each resonant mode can be minutely adjusted with respect to the resonant frequency. Therefore, the difference in frequency between the two modes can be fine tuned easily.

In an embodiment of the resonator comprising a superconductor as the conductor material, the following advantages can be accomplished. Although using a superconductor as the conductor material extremely decreases the conductor loss to dramatically improve the Q-value in a resonator, superconductivity will no longer be maintained when the maximum current density of the conductor exceeds the value of the critical current density against a high-frequency current of the superconductor. Therefore, the resonator is disabled. However, since the resonator of the present invention curbs the maximum current density enabling the use of a high-power high-frequency signal, using a superconductor as the conductor material enables the resonator to have a high Q-value even for a high-power high-frequency signal.

In an embodiment of the first example of the high-frequency circuit element of the present invention in which two points where only one of the two dipole modes of the resonant modes of the resonator polarizing orthogonally is excited on the circumference of the conductor are the input/output bonding points 1, 2 and input/output terminals 1, 2 are bonded to the resonator at the input/output bonding points 1, 2, respectively, since transmission between the input/output terminals indicates that a resonant characteristic has reached maximum at the resonant frequency of the excitation mode, the high-frequency circuit element of this invention can practically be used as a band-passing filter by properly adjusting the bonding at the input-output bonding points 1, 2.

In an embodiment of the first example of the high-frequency circuit element of the present invention in which there are two points on the circumference of the conductor where only one of the two dipole modes among the resonant modes of the resonator polarizing orthogonally is excited are the input/output bonding points 1, 2, and the other two points where only the other one of the two dipole modes is excited are the input/output bonding points 3, 4. At the input/output bonding points 1–4, the input/output terminals are bonded to the resonator, respectively, since it can operate independently either at the input/output terminals bonded to the input/output bonding points 1, 2 as a resonator for one resonant frequency mode and at the input/output terminals bonded to the input/output bonding points 3, 4 as the resonator for the other resonant frequency mode, the area of the resonator can be effectively used and subsequent reduction in size of the element can be achieved.

In an embodiment of the first example of the high-frequency circuit element of the present invention in which two points on the circumference of the conductor at which both of the two dipole modes (resonant frequency $f_A$, $f_B$) of the resonant modes A, B of the resonator polarizing orthogonally are equally excited and are located at neighboring positions are the input/output bonding points 1, 2. The input/output terminals are bonded to the resonator at the input/output bonding points 1, 2, respectively, since the input/output characteristic of the input/output terminals is the same as the characteristic of two resonators having different resonant frequency $f_A$, $f_B$ connected in parallel. By setting the degree of the input/output coupling, the element can operate as a two-stage band passing filter having a bandwidth of $|f_A-f_B|$. Since the two-stage band passing filter is simply formed by bonding input/output terminals to a conductor, reduction in the size of the element can be achieved.

In an embodiment of the first example of the high-frequency circuit element in which two points at which both of the dipole modes (resonant frequency $f_A$, $f_B$) of the resonant modes A, B of the resonator polarizing orthogonally are equally excited and are located opposite each other on the circumference of the conductor are the input/output bonding points 1, 2. Input/output terminals are bonded to the resonator at the input/output bonding points 1, 2, since the embodiment has the same function as two resonators connected parallelly with the phases of the two resonators inverted, the outputs of the two resonators interfere each other to provide a high-frequency circuit element with a filter characteristic having the maximum transmittance at the frequency $f_A$, $f_B$ and the minimum transmittance at the frequency $(f_A+f_B)/2$ can be provided.

In an embodiment of the first example of the high-frequency circuit element in which a point where both of the two dipole modes (resonant frequency $f_A$, $f_B$) of the resonant modes A, B of the resonator are excited is the input/output bonding point 1, a point where only one of the dipole modes A (resonant frequency $f_A$) is excited is the input/output bonding point 2, a point where only the other one of the dipole modes B (resonant frequency $f_B$) is excited is the input/output bonding point 3, and the input/output terminals are bonded to the resonator at the input/output bonding points 1–3, respectively, when a high-frequency signal is input to the input/output terminal bonded to the resonator at the input/output bonding point 1, the frequency components adjacent to the frequency $f_A$ of the high-frequency signal couple with mode A, and the frequency components adjacent to the frequency $f_B$ couple with mode B. The frequency components coupled with mode A are output only to the input/output terminal bonded to the resonator at the input/output bonding point 2, and the frequency components coupled with mode B are output only to the input/output terminal bonded to the resonator at the input/output bonding point 3. Accordingly, the high-frequency circuit element functions as a displexer separating frequency components of the inputted signal. Since the displexer comprises only a resonator having one conductor, it contributes to the reduction in the size of the element. Moreover, if the input/output terminal to be bonded to the resonator at the input/output bonding point 2 and the input/output terminal bonded to the resonator at the input/output bonding point 3 are used for signal input, and the input/output terminal to be bonded to the resonator at the input/output bonding point 1 is used for signal output, the embodiment can function as a integrating filter.

An embodiment of the first example of the high-frequency circuit element in which the input/output terminals are comprised of transmission lines and one end of a transmission line is coupled with the conductor comprising the resonator by capacitance or inductance provides the following advantages. Since capacitance coupling realizes a large external Q, it provides a good match for a resonator having a large Q-value (unloaded Q). Since inductance coupling realizes a small external Q, it provides a good match for a resonator having a small Q-value (unloaded Q). In another embodiment in which the end of the transmission line is coupled with the circumference of the conductor with a gap portion therebetween, since a capacitive optional part such as a capacitor is not needed, the structure of the high-frequency circuit element can be simplified. In another embodiment in which the ends of the transmission lines are widened, since it is not necessary to narrow the width of the gap portion even when a strong input/output bonding is needed, problems of production accuracy or electric discharge when a large power is used can be solved.

In an embodiment of the first example of the high-frequency circuit element of the present invention that a superconductor is used as the conductor material, a high-frequency circuit element having an excellent characteristic even when applied for a high-frequency circuit element of a large power.

In the second example of the high-frequency circuit element of the present invention in which there are a plurality of resonators comprising a conductor formed on a substrate having two dipole modes orthogonally polarizing without degeneration as the resonant modes with the resonators bonded to each other, increased reduction of insertion loss is obtained at the boundary of the pass band and the blocking band.

In an embodiment of the high-frequency circuit element in which two points where both of the two dipole modes orthogonally polarizing without degeneration of the resonant modes of each resonator are equally excited and are located at neighboring positions are input/output bonding points 1, 2. The plurality of resonators are bonded in series at input/output bonding points 1, 2, and at the bonding points of the resonators located at the ends of the plurality of resonators and not bonded to the neighboring resonator, the input/output terminals are bonded to the resonators at the ends. By setting the degree of the coupling at each bonding point and the resonant frequency of the two dipole modes of each conductor, a band pass filter having increased transmittance compared to a one-stage or two-stage band pass filter can be achieved. Further, since a 2n-stage band pass filter can be provided by using n pieces of resonators, a band pass filter of a compact size having a larger number of stages compared to conventional band pass filters can be achieved.

DETAILED DESCRIPTION OF THE INVENTION

This invention will be described in detail with reference to the attached figures.

Figure 1:
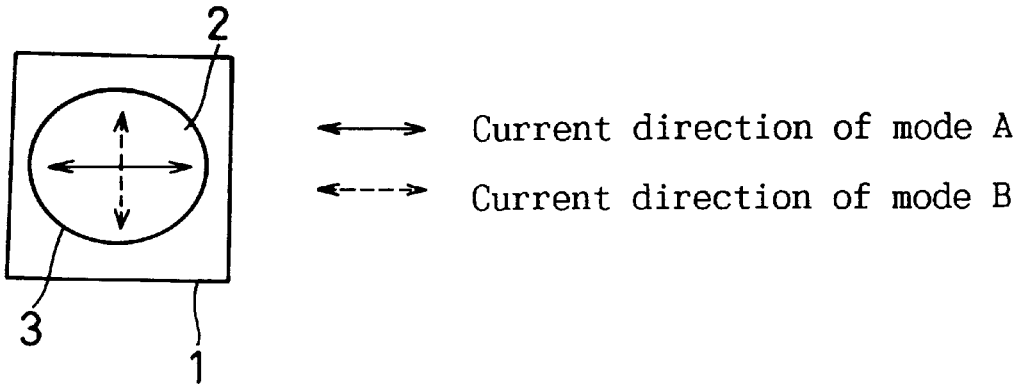
FIG. 1 illustrates a plan view of a first embodiment of a resonator of the present invention.

FIG. 1 illustrates a plan view of a first embodiment of the resonators of the present invention. As can be observed in FIG. 1, an elliptical metal film conductor 2 is formed on a substrate 1 comprising monocrystal of a conductor by such means of vacuum deposition and etching. Ground plane 13 may be formed on the rear side of the substrate 1 as need (see FIG. 14).

By properly coupling a high-frequency signal with the conductor 2, such structure can operate resonating and provide a resonator. In FIG. 1, the high-frequency current directions of the two fundamental modes where the resonant frequency is the lowest (herein they are called mode A and mode B, the resonant frequency thereof $f_A$ and $f_B$, respectively) are described roughly with arrows. The electromagnetic field or the accompanying potential profile of a resonant mode can be estimated by calculation to some extent. The two modes, mode A and mode B, have current directions in the same direction as the two axes of the ellipse, orthogonal to each other. These modes are called "dipole modes" in a conventional round-type resonator, and are called the same herein. Since dipole modes can exist independently at the same time, the two modes function like two resonators. In the case when the conductor 2 has a completely round shape, the two dipole modes degenerate and the resonant frequency of the two modes are the same. On the other hand, if the conductor 2 has an elliptical shape as shown in FIG. 1, the two modes do not degenerate to enable mode A and mode B to have different resonant frequencies. The resonant frequency of the two modes can be set by adjusting the length of the longer axis and the shorter axis of the elliptical shape. By using the two modes independently, one resonator can provide the function of two resonators having different resonant frequencies to efficiently use the area of the resonator circuit and enable reduction in the size of the resonator.

Figure 21:
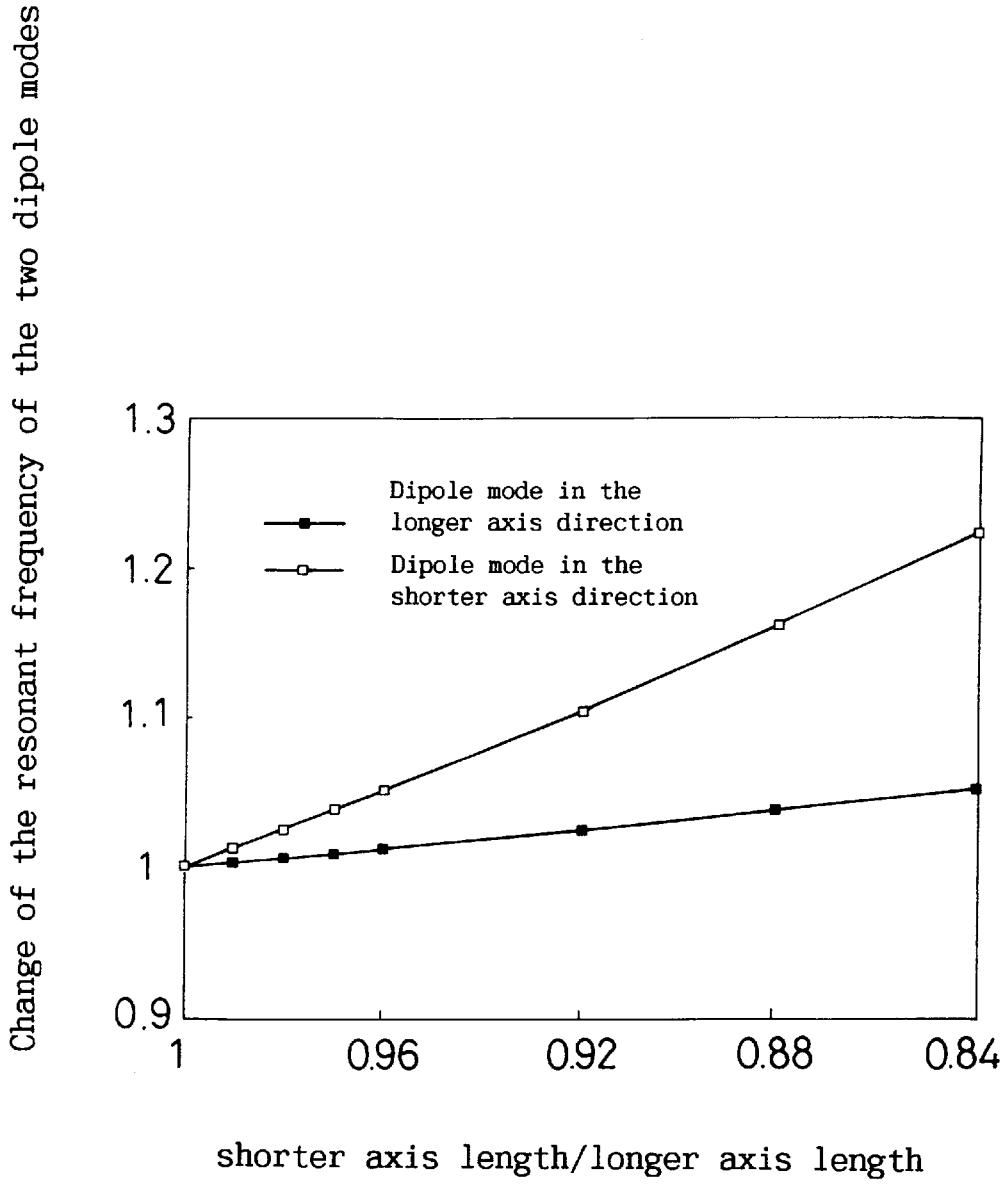
FIG. 21 illustrates a graph describing the relation of the ratio of the shorter and the longer axes of a resonator of the present invention and a resonant frequency of the dipole modes.

FIG. 21 illustrates a comparison of the change of resonant frequency of the two modes in terms of the ratio of the length of the shorter and the longer axes (shorter axis length/longer axis length) with the area of the conductor 2 conserved compared with a completely round conductor (shorter axis length/longer axis length equals 1). Since the resonator of the present invention has different resonant frequencies, the coupling of the two dipole modes is very small, and except where the two modes have very close resonant frequencies (shorter axis length/longer axis length almost equals 1), the two resonant modes can be regarded as functioning independently. In other words, "without degeneration" in this invention means that the resonator does not have a completely round shape. For example, when an elliptically-shaped resonator as shown in FIG. 1 is used, it is preferable that the ellipticity ranges from 0.1 to 1.

In the conventional round-type resonators, since high-frequency current distributes two-dimensionally and comparatively evenly, this type has little conductor loss and little influence of the radiation loss, thereby having a very high Q (unloaded Q) as compared with resonators with the planar circuit structures of the other shapes or transmission line resonators such as half wavelength resonators. On the other hand, since the resonators of the present invention only need to have a difference in length between the longer axis and the shorter axis of approximately 10% to have a 10% resonant frequency differences between mode A and mode B as shown in FIG. 21, the resonators are expected to have nearly the same current distrubution as a round-type resonator except when the resonant frequencies of the two modes are very different. Thus, in a resonator of the present invention, high-frequency current distributes relatively uniformly and has little radiation loss to achieve a very high Q.

In the resonators of the present invention, having two-dimensional spreading distribution of high-frequency current indicates that the maximum current density in a resonant operation when applied to the high-frequency signal of the same power is controlled. For that reason, the resonators of the present invention prevent problems caused by the excessive concentration of the high-frequency current such as deterioration of conductor materials by heat even when using a strong high-frequency signal.

Further, using a superconductor for the material of the conductor 2 of a resonator of the present invention is more effective. In general, using a superconductor as the conductor material of a resonator provides a considerable decrease in conductor loss which increases the resonator's Q-value drastically. However, when the maximum current density in the conductor exceeds the value of the superconductor material's critical current density against a high-frequency current, the superconducting characteristic will be ruined and disables the resonator. As mentioned before, since resonators of the present invention curb the maximum current density, by forming the conductor 2 with a superconductor, a high-frequency signal of a larger power can be used as compared with resonators with conventional structures. Subsequently, a resonator having a very high Q-value for a strong high-frequency signal is possible.

The above-mentioned advantages of the resonators of the present invention are equally displayed in the high-frequency circuit elements using a resonator of the present invention described hereinafter. Further, when the Q-value of the resonator is high, it is very effective to have the resonator as an element of the high-frequency circuit element since it contributes to curbing loss.

Figure 2:
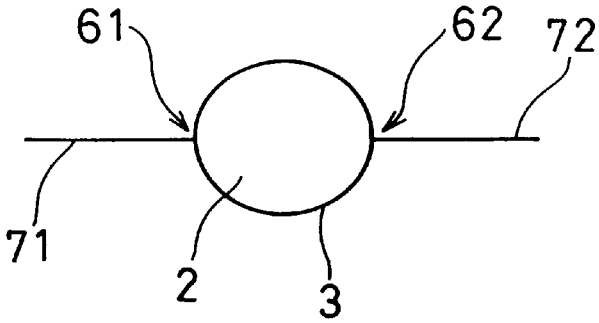
FIG. 2 illustrates a plan view of a first embodiment of the first example of high-frequency circuit elements having a resonator of the present invention.

FIG. 2 illustrates an example of the high-frequency circuit elements of the resonators of the present invention. To use the resonator of FIG. 1, desired resonant modes (dipole modes) should be excited to display the expected function. One way to excite the desired modes is to bond the input/output terminals to the conductor 2 at appropriate points on the circumference 3 of the conductor 2 is very simple and certain to excite a desired mode, and thus effective. Points at which only mode A of the resonator is excited and mode B is not excited are input/output bonding points 61, 62 and input/output terminals 71, 72 are bonded thereto. One of the input/output terminals 71, 72 is used as the input end of the high-frequency signal, and the other is used as the output end. Positions of input/output bonding points 61, 62 are at the points where the axes of symmetry of the ellipse and the circumference 3 intersect. Each dipole mode has two such points. If the conductor 2 has another shape but an ellipse and applied with capacitance coupling (for example, by such means as connecting to a capacitor), positions of input/output bonding points 61, 62 can be determined by calculating the potential profile of mode A and finding the points at which the electric potential becomes maximum (current becomes 0) on the circumference 3. When the conductor is applied with inductance coupling which excites the electric current (for example, by such means as connecting to something having inductance such as a tap), positions of the input/output bonding points 61, 62 can be determined by calculating the potential profile of mode A and finding the points at which the electric potential becomes 0 (current becomes maximum).

In such structure, the transmission characteristic of the input/output terminals 71, 72 exhibits the resonant characteristic having the peak at the resonant frequency $f_A$ of mode A, and by adjusting the degree of the coupling at the input/output bonding points 61, 62 appropriately, the high-frequency circuit element can be used as a one-stage band pass filter.

Figure 3:
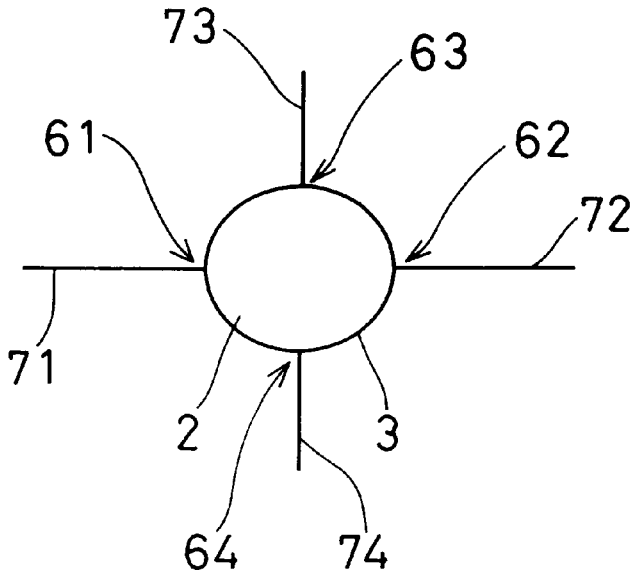
FIG. 3 illustrates a plan view of a second embodiment of the first example of the high-frequency circuit elements having a resonator of the present invention.

FIG. 3 illustrates another example of the high-frequency circuit element using a resonator of the present invention. In addition to the structure of FIG. 2, input/output bonding points 63, 64 where only mode B is excited but mode A is not excited are determined and input/output terminals 73, 74 are bonded thereto. As mentioned before, since mode A and mode B are not degenerated, coupling of the two modes seldom occurs. Accordingly, the high-frequency circuit element of the present invention can operate independently as a resonator having resonant frequency $f_A$ at input/output terminals 71, 72, and as a resonator having resonant frequency $f_B$ at input/output terminals 73, 74. Thereby, the area of a resonator is used efficiently and allows reduction in the size of the element in addition to the advantages of the resonator of the present invention already stated.

Figure 4:
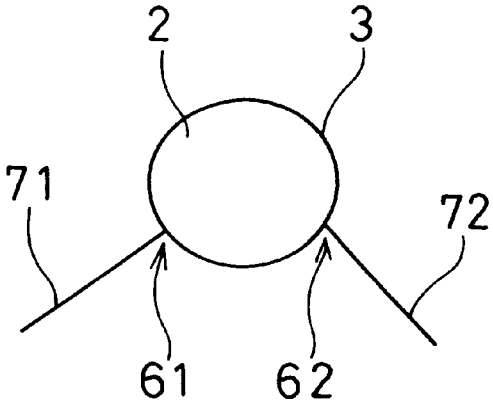
FIG. 4 illustrates a plan view of a third embodiment of the first example of the high-frequency circuit elements having a resonator of the present invention.

FIG. 4 illustrates a further different example of the high-frequency circuit element using a resonator of the present invention. Approximately at points equally between two neighboring input/output bonding points of input/output bonding points 61–64 of FIG. 3 (for example, the position midway between the input/output bonding points 61 and 63) are four points at which both mode A and mode B can be equally excited. In the high-frequency circuit element of FIG. 4, two neighboring points among the four points on the circumference where the both modes can be excited equally are the input/output bonding points 61, 62 and the input/output terminals 71, 72 are bonded thereto. The input/output characteristic of the input/output terminals 71, 72 becomes the same as the characteristic of two resonators having resonant frequency $f_A$ and resonant frequency $f_B$ connected in parallel. Therefore, by adjusting the input/output bonding, the high frequency circuit element can operate as a two-stage band pass filter having a bandwidth of $|f_A-f_B|$. Compared to two-stage band pass filters generally comprising a structure with two half-wavelength transmission line resonators bonded together, the high-frequency circuit element of the present invention has a simple and compact structure formed by bonding the input/output terminals 71, 72 to an elliptical-shaped conductor 2. Besides, since a resonator of the present invention has a higher Q-value than conventional half-wavelength transmission line resonators, it contributes not only to reducing the size of a filter but also to loss reduction.

Figure 5:
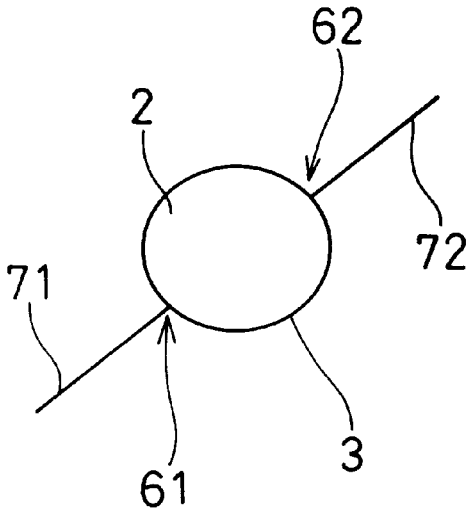
FIG. 5 illustrates a plan view of a fourth embodiment of the first example of the high-frequency circuit elements having a resonator of the present invention.

FIG. 5 illustrates another example of the high-frequency circuit element having a resonator of the present invention. In the high-frequency circuit element of this structure, among the four input/output bonding points on the circumference 3 of conductor 2, two points opposite each other are the input/output bonding points 61, 62. Similar to the structure of FIG. 4, this structure has the characteristics of the two resonators having a resonant frequency $f_A$ and a resonant frequency $f_B$ connected in parallel. But different from the case of FIG. 4, in this structure, since the phases of the two resonators are inverted and connected in parallel, the outputs of the two resonators interfere with each other to provide a high-frequency circuit element having a filter characteristic with the maximum transmission at the frequency $f_A$, $f_B$, and the minimum transmission at the frequency $(f_A+f_B)/2$.

Figure 6:
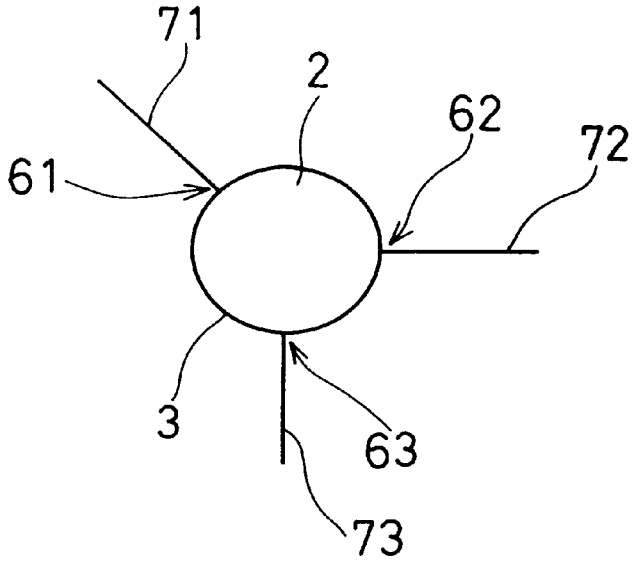
FIG. 6 illustrates a plan view of a fifth embodiment of the first example of the high-frequency circuit elements having a resonator of the present invention.

FIG. 6 illustrates a further different example of the high-frequency circuit element having a resonator of the present invention. In FIG. 6, a point at which the two dipole modes (mode A, mode B) of the resonator is equally excited is the input/output bonding point 61, a point at which only mode A is excited is input/output bonding point 62, a point at which only mode B is excited is input/output bonding point 63. At the input/output bonding points 61–63, input/output terminals 71–73 are bonded, respectively. With this structure, when a high-frequency signal is input to the input/output terminal 71, the frequency components adjacent to the frequency $f_A$ of the high-frequency signal are coupled with mode A and the frequency components adjacent to the frequency $f_B$ are coupled with mode B. The frequency components coupled with mode A will be output only to input/output terminal 72, and the frequency components coupled with mode B will be outputted only to the input/output terminal 73. Accordingly, the high-frequency circuit element of the present invention provides a diplexer separating frequency components of an input signal. Moreover, when input/output terminals 72, 73 are used for signal input and input/output terminal 71 for signal output, it functions as an integrating filter. Compared to a conventional displexer which requires at least two resonators, the high-frequency circuit element of the present invention needs only one resonator comprised of one elliptical conductor which allows the size of the device to be reduced in addition to the advantages of the resonators of the present invention already stated.

FIGS. 2–6 illustrate a high-frequency circuit element comprising a resonator with a single elliptical conductor. Another type of high-frequency circuit elements can be formed by combining a plurality of resonators. A high-frequency circuit element as shown in FIG. 4 can operate as a two-stage band pass filter, but if additional decrease in the insertion loss at the boundary of the pass band and the blocking band is desired, the number of the stages in the filter needs to be increased.

Figure 7:
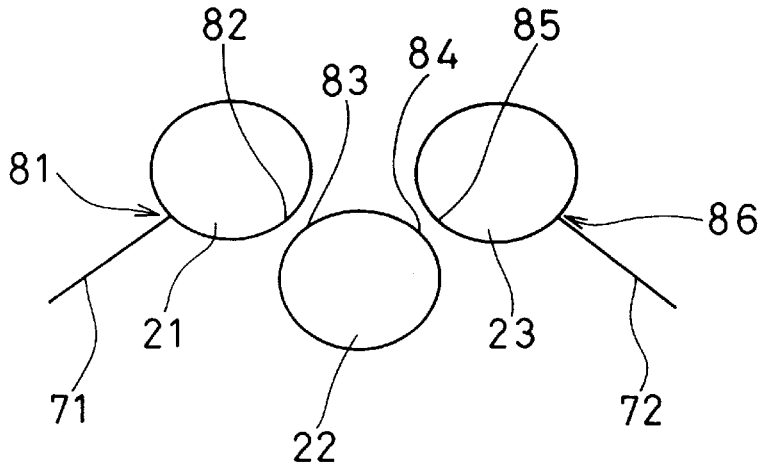
FIG. 7 illustrates a plan view of an embodiment of the second example of the high-frequency circuit elements having a resonator of the present invention.

FIG. 7 illustrates an example of a band pass filter having two or more stages which uses a resonator having a plurality of elliptical conductors. A band pass filter having six stages is formed using three conductors 21–23. In conductors 21–23 of FIG. 7, neighboring points at which the two dipole modes are equally excited among the four points on the circumference are the bonding points 81–86. At the conductors at the ends 21, 23, the input/output terminals 71, 72 are bonded to the bonding points 81, 86, respectively. The conductors 21, 23 are bonded directly to the conductor 22 at bonding points 82–85. In this structure, by properly adjusting the degree of the coupling of bonding points 81–86 and resonant frequency ($f_A$, $f_B$) of the two dipole modes of the conductors 21–23, an additional transmission of a band pass filter as compared to a one-stage or two-stage band pass filter can be formed.

Though the FIG. 7 is an example of a six-stage band pass filter, it is not so limited. The number of stages can be increased further. In general, by using n resonators, a band pass filter of 2n stages can be provided. Accordingly, the structure of the high-frequency circuit element of the present invention also allows reduction in the size of band pass filters while increasing the number of stages as compared to conventional band pass filters.

Figure 8:
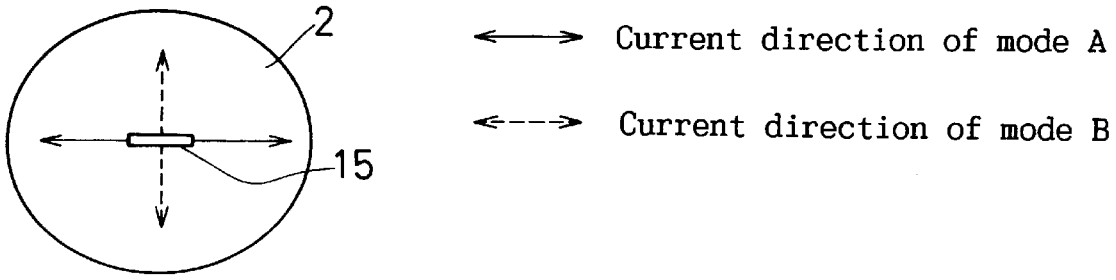
FIG. 8 illustrates a plan view of a second embodiment of the resonators of the present invention.

FIG. 8 illustrates another example of a resonator of the present invention. As can be seen in FIG. 8, the conductor 2 has a slit 15 in the center. In this case, the conductor 2 similarly operates as a resonator. By changing the orientation or the length of the slit 15, the resonant frequencies of the two resonant modes can be changed. Therefore, fine adjustment of the resonant frequencies of the two resonant modes can be conducted by adding a slit 15 after completion of the resonator, or by extending the length of slit 15 which is already formed. When the orientation of the slit 15 and the current direction of one resonant mode are the same (mode A in the case of FIG. 8), although the existence of the slit 15 has little influence on the current distribution of the mode or on the resonant frequency, since the current distribution of the other mode (mode B in the case of FIG. 8) is considerably influenced by slit 15, the resonant frequency changes accordingly. Extending the length of the slit 15 lowers the resonant frequency. Therefore, by producing a slit 15 oriented perpendicular to the current direction of one mode, only the resonant frequency of that mode can be fine tuned, thereby enabling the fine adjustment of the difference of the frequency of the two modes. Further, if two slits are formed and oriented perpendicular to the current directions of the both modes, respectively, the two modes can be finely adjusted individually. In general, to change the resonant frequency in a round-type resonator, the radius of the round plate must be changed. Therefore, it is very difficult to finely adjust the resonant frequency after completion of the resonator. However, by using the structure of the present invention of forming slits with proper lengths and orientations after completion of the resonator, the resonant frequency of the two resonant modes can be finely tuned individually.

Figure 9:
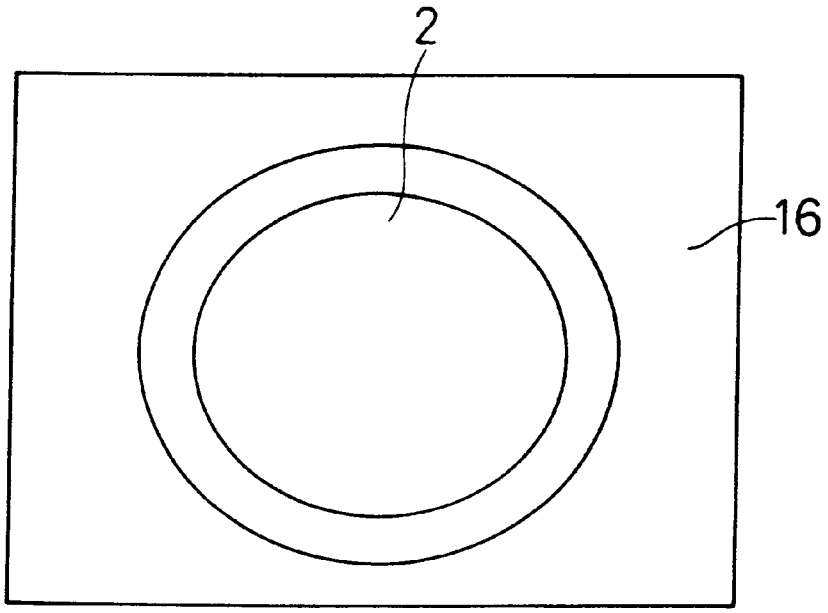
FIG. 9 illustrates a plan view of a third embodiment of a resonator used for an embodiment of the first example of high-frequency circuit elements of the present invention.

When the resonator has a microstrip line structure or a strip line structure, as FIG. 9 illustrates, it is possible to use a grounding electrode 16 in the circumference of the conductor 2 comprising the resonator. Since a grounding electrode prevents unstable operation due to the partial leakage of the electromagnetic waves, it is useful. When a material with little loss such as a superconductor is used for the conductor 2, since even a very little leakage often casts a great influence on the characteristic, the structure is especially useful. If input/output is conducted with the structure, the input/output terminals can be guided to the conductor 2 by partially cutting the grounding electrode 16. (see FIG. 18(*a*))

Figure 10:
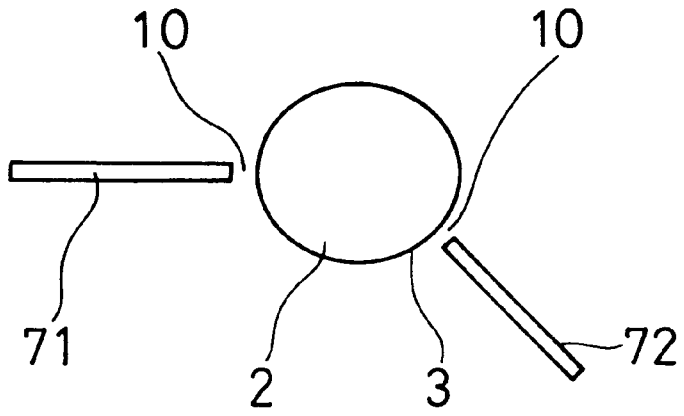
FIG. 10 illustrates a plan view of a seventh embodiment of the first example of the high-frequency circuit elements having a resonator of the present invention.
Figure 11:
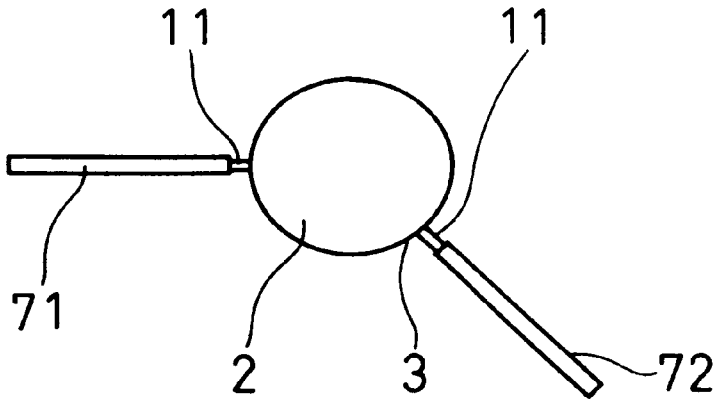
FIG. 11 illustrates a plan view of a seventh embodiment of the first example of the high-frequency circuit elements having a resonator of the present invention.

It is useful to couple the input/output terminals and the conductor comprising the resonator by either capacitance coupling or inductance coupling. FIG. 10 illustrates one embodiment using the capacitance coupling. When capacitance coupling can be achieved forming a gap between the conductor and input/output terminals 71, 72 comprised of transmission lines. Since such capacitance coupling provides a large external Q, it provides a good match when the Q-value of the resonator (unloaded Q) is large. Further, in addition to coupling by a gap, capacitance coupling can be achieved by using optional capacitive parts (such as a capacitor) to connect input/output terminals 71, 72 and the circumference 3 of the conductor 2 directly. FIG. 11 illustrates one example of inductance coupling. Inductance coupling is achieved by the inductance at the tap 11. Since such inductance coupling provides a small external Q, it provides a good match when the Q-value of the resonator (unloaded Q) is small. Further, in addition to such coupling with a tap 11, the inductance coupling can be achieved by using optional inductive parts (such as a coil) or by using a fine lead line of a proper length to connect the input/output terminals 71, 72 and the circumference 3 of the conductor directly.

Figure 12:
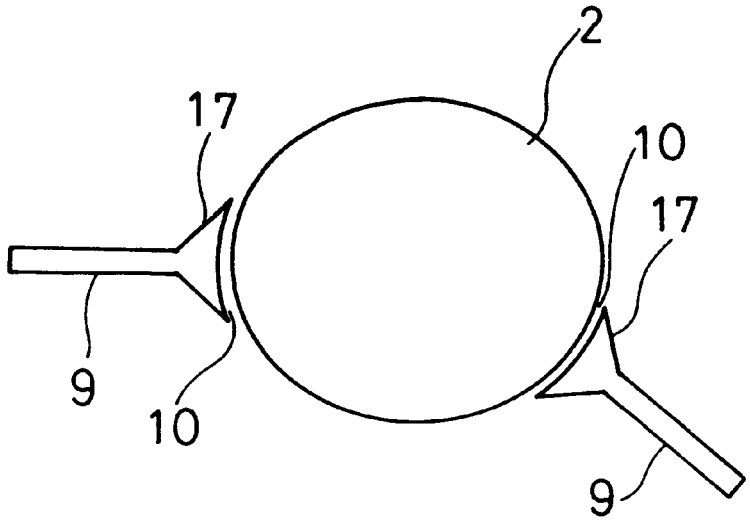
FIG. 12 illustrates a plan view of an eighth embodiment of the first example of the high-frequency circuit elements having a resonator of the present invention.

If a high degree of input/output coupling is needed in FIG. 10, the distance of the gap 10 can be narrowed, but only to a certain extent due to problems caused by production accuracy or discharge when a large power is used. As shown in FIG. 12, by widening the end of the transmission line 17 of the input/output terminals 71, 72 at the coupling portions, since the gap 10 does not have to be narrowed even when a high degree of the input/output coupling is needed, the above-mentioned problems can be solved.

Figure 13:
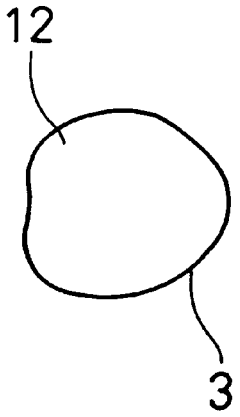
FIG. 13 illustrates a plan view of a fourth embodiment of the resonator of the present invention.

Resonators comprising an elliptical-shaped conductor are explained in the FIGS. 1–11. But the conductor is not always required to have an elliptical shape because if only two dipole modes are orthogonally polarizing without degeneration as the resonant modes even when a planar circuit resonator has an optional shape like the conductor 12 in FIG. 13, it functions similarly. However, if the outline of conductor 12 is not smooth, it is possible that the Q-value may deteriorate due to the increased loss caused by the partial excessive concentration of the high-frequency current, or that problems may arise when a high-power high-frequency signal is input. Thus, if an elliptical-shaped conductor is not used, a conductor having a smooth outline 12 would enhance its efficiency.

Figure 14:
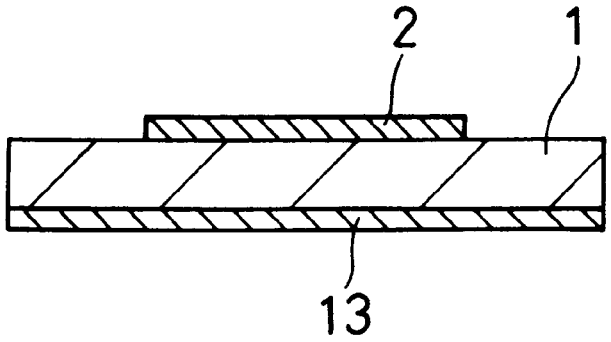
FIG. 14 illustrates a section view of a fifth embodiment of the resonator of the present invention.
Figure 15:
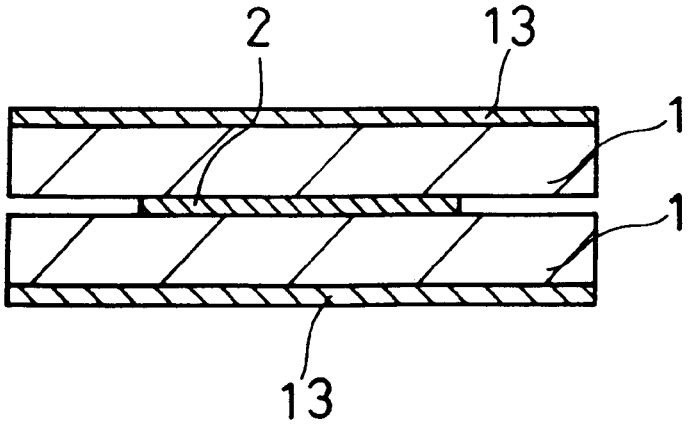
FIG. 15 illustrates a section view of a sixth embodiment of the resonator of the present invention.
Figure 16:
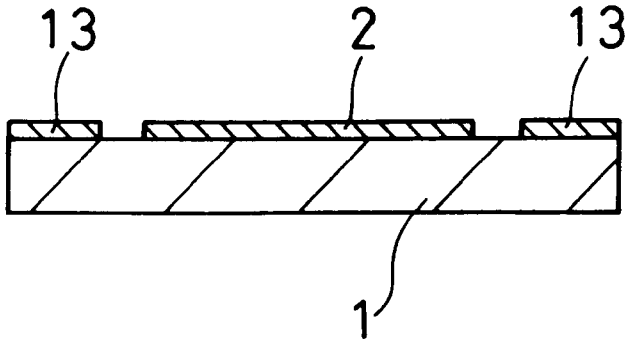
FIG. 16 illustrates a section view of a seventh embodiment of the resonator of the present invention.

As a structure including the resonator's grounding plane, for a resonator or a high-frequency circuit element of the present invention, the microstrip line structure, the strip line structure, or the coplaner wave guide structure, shown in FIGS. 14–16, respectively, exhibit similar characteristics. Among them, the microstrip line structure (FIG. 14) has considerable radiation loss, but since the structure is simple, it is most commonly used and matches well with other circuits. Although the strip line structure (FIG. 15) has a complicated structure, since it has little radiation loss, it provides a high-frequency circuit element with little loss. Since the coplaner wave guide structure (FIG. 16) may comprise all the elements including the ground plane 13 on one side of the substrate, it simplifies the production process. This structure is especially useful when a high-temperature superconductor thin film which is difficult to form on the both sides of the substrate is used as the conductor material.

Figure 17:
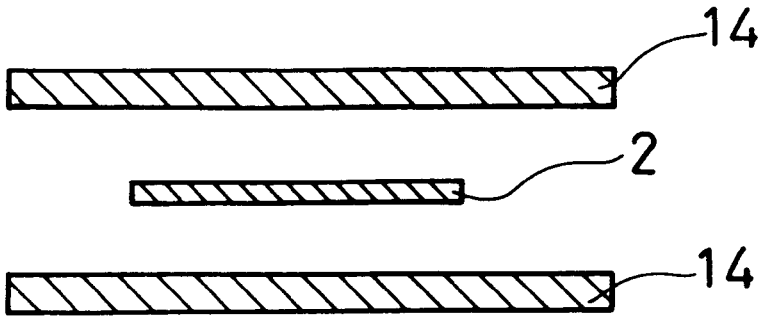
FIG. 17 illustrates a section view of an eighth embodiment of the resonator of the present invention.

Further, a resonator or a high-frequency circuit element may have a structure in which the conductor 2 is disposed between two parallel conductor planes 14, 14, as illustrated in FIG. 17. The structure is similar to the strip line structure described in FIG. 15, but it does not have the substrate 1 as in FIG. 15 and therefore the conductor 2 is in the air. In this case, the conductor 2 is surrounded by air (or a vacuum or an appropriate gas), in particular, a material with a low relative dielectric constant. The characteristic impedance of the resonator increases to reduce the high-frequency current flowing in the conductor 2 and to lessen the loss in the resonator. Therefore, it is the most preferable structure to accomplish a high Q-value. To place the conductor 2 between the conductor planes 14, 14, it is effective to use a material 170 having a low dielectric constant such as teflon.

Although in the high-frequency circuit elements of the present invention illustrated so far have a metal thin film as the conductor material, the material is not limited only to a metal film but other materials including a superconductor thin film can be used. Since a superconductor material has far less loss than a metal, it provides a resonator with a very large Q. Therefore, it is effective to use a superconductor in a high-frequency circuit element of the present invention. However, it is impossible to have a superconducting current flow in a superconductor beyond the value of the critical current density. This would cause a problem when a high-frequency signal is used. Since a high-frequency circuit element of the present invention uses a resonator having an elliptical-shaped conductor, the high-frequency current distributes two-dimensionally and relatively evenly to reduce the maximum current density as compared to a half-wave resonator when a high-frequency signal of the same power is input. For that reason, when the resonators comprised of superconductor material having the same critical current density, the resonator of the present invention can deal with a high-frequency signal of a larger power. Therefore, in a high-frequency circuit element of the present invention, by using a superconductor as the conductor material, a high-frequency circuit element having a fine characteristic to a high-frequency signal can be accomplished.

Figure 18A:
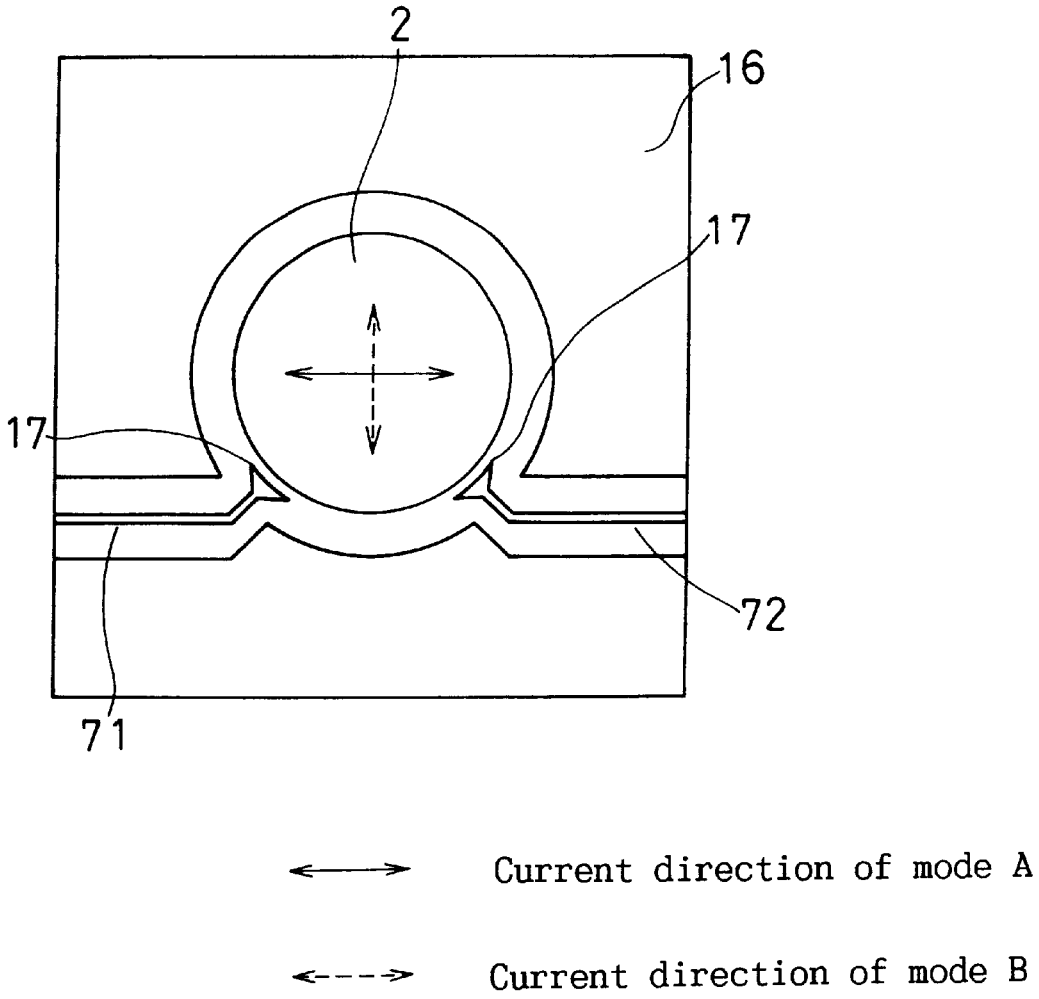
FIG. 18(*a*) illustrates a plan view of a ninth embodiment of the first example of the high-frequency circuit elements having a resonator of the present invention, FIG. 18(*b*) illustrates a section view of FIG. 18(*a*)
Figure 18B:
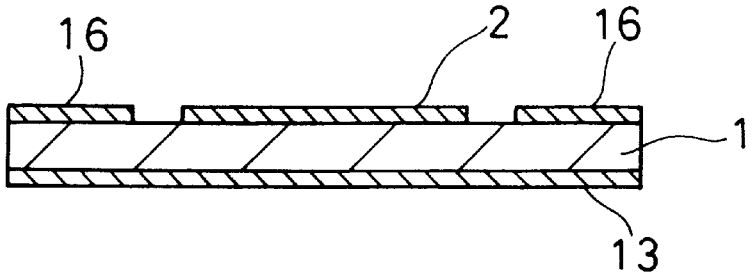
Figure 19:
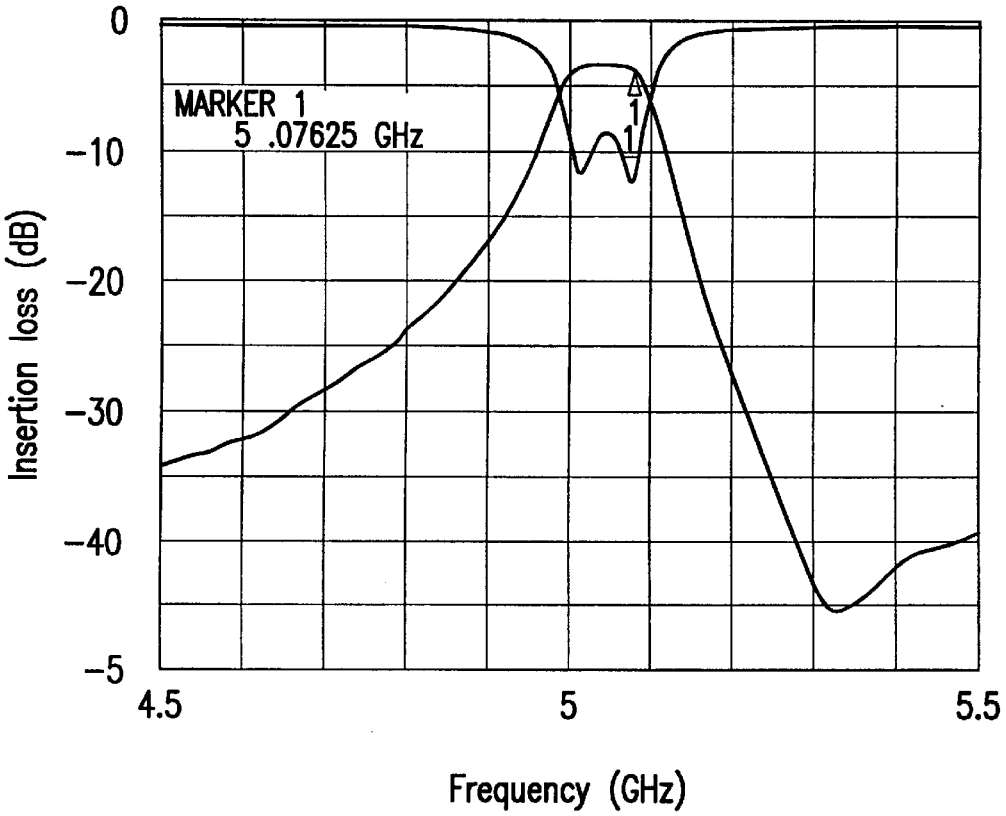
FIG. 19 illustrates a graph of a result of measuring frequency response describing the characteristic of the high-frequency circuit element illustrated in FIGS. 18(*a*) and 18(*b*)

FIGS. 18(*a*) and 18(*b*) are an embodiment of the high-frequency circuit element (filter). It is designed to have the desired characteristic of the central frequency of 5 GHz and the band range of approximately 2%. The production process is as follows. First, a conductor thin film having a two layer structure is formed by laminating a titanium thin film of 10 nm thickness and a metal film of 1 $\mu$m thickness in order onto both sides of a substrate 1 comprising a monocrystal of lanthanum almina ($LaAlO_3$) of the size 12 mm×12 mm, thickness 0.5 mm by means of vacuum deposition. The titanimum thin film is used to improve the adhesion of the metal film and the substrate. Second, by means of photolithography and argon ion beam etching, the conductor thin film of one side is patterned to the elliptical conductor 2, the input terminals 71, 72 and the grounding electrode 16. The conductor thin film on the rear side of the substrate 1 is used as the ground plane 13. The patterned shapes have the longer axis of the elliptical conductor 2 as 7 mm, the shorter axis as 6.86 mm, and the line width of the input/output terminals 71, 72 as 0.15 mm. At the edges 17 of the input/output terminals 71, 72, the line width is widened to 1.22 mm and the edges have a gap of 20 $\mu$m between the conductor 2 to have capacitance coupling. The distance between grounding electrode 16 and conductor 2, input/output terminals 71, 72 is about 1 mm. The microwave characteristic is measured with HP-8510B Network Analyzer (manufactured by Hewlett-Packard Company). FIG. 19 illustrates the frequency response characteristic of the filter of FIGS. 18(*a*) and 18(*b*). As seen from FIG. 19, the filter has the characteristic of a two-step band pass filter.

Figure 20:
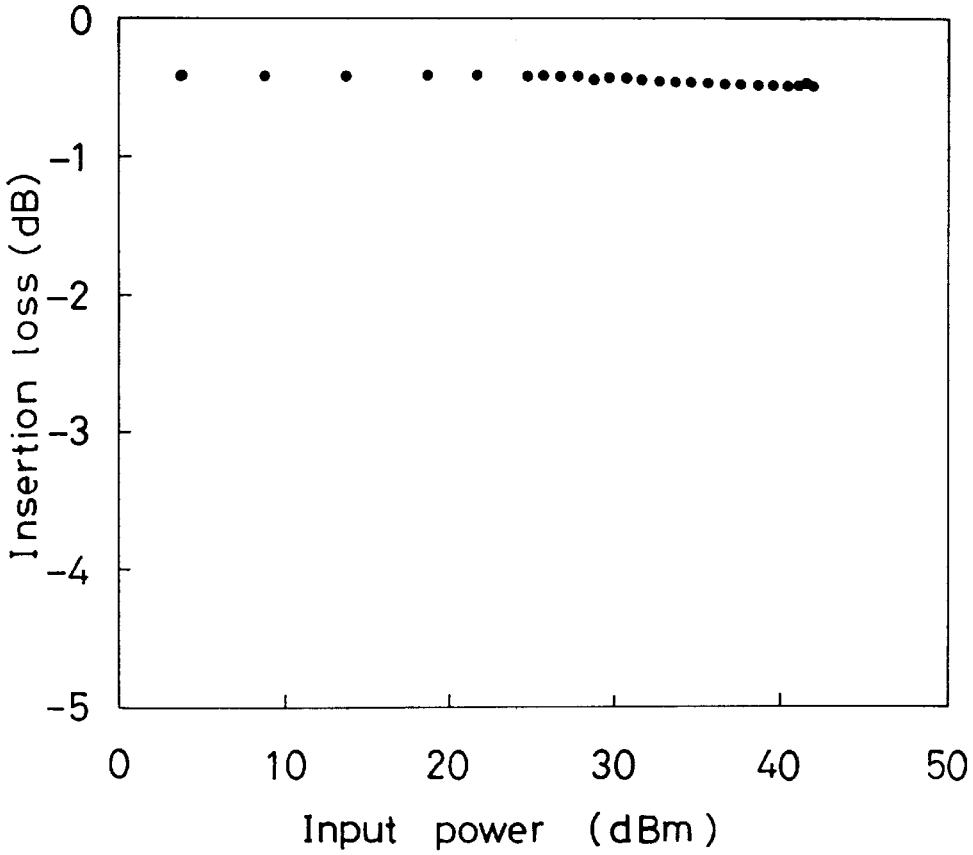
FIG. 20 illustrates a graph describing a result of measuring the change of insertion loss in terms of inputted power when the conductor is formed with a high-temperature superconductor thin film in the high-frequency circuit element illustrated in FIG. 18.
Figure 22:
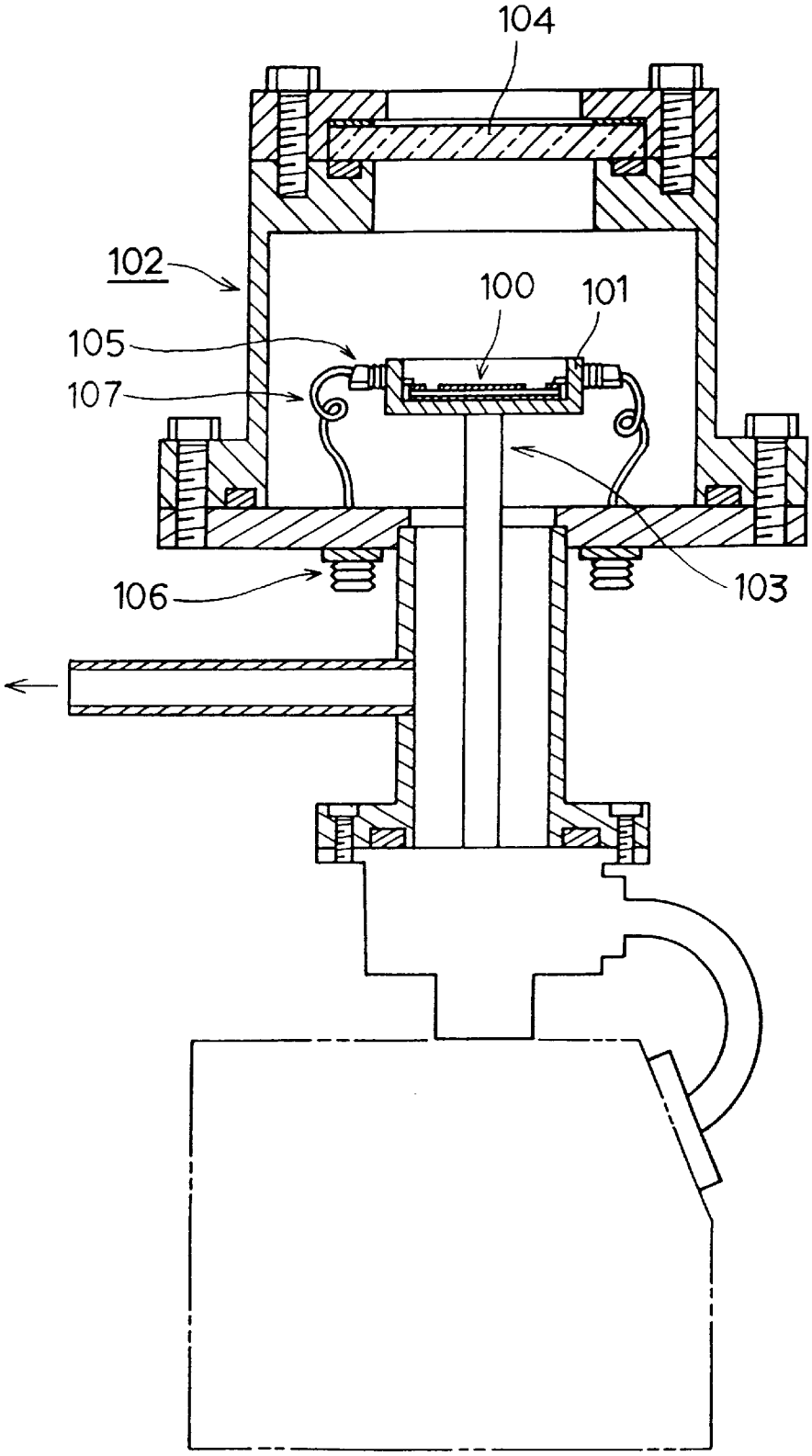
FIG. 22 illustrates a section view of a freezing chamber of a He gas circulating freezer having a high-frequency circuit element of the present invention with a high-temperature superconducting thin film equipped therein as the conductor.

Further, a filter with a similar pattern (see FIG. 18) is formed on a lanthanum almina substrate with TlBaCaCuO superconductor thin film (0.7 $\mu$m thickness). For the ground plane on the rear side of the substrate, a conductor thin film of two layer structure formed by laminating a titanium thin film of 10 nm thickness and a metal thin film of 1 $\mu$m thickness is used. When measuring the microwave characteristic, as shown in FIG. 22, temperature is controlled by attaching a manufactured filter chip 100 to a brass jig 101 and attaching it to the refrigerating chamber of the He gas circulation refrigerator 102. In FIG. 22, numeral 103 describes cold head, 104 reinforced glass for the window, 105, 106 high-frequency connector, and 107 high-frequency cable. The microwave characteristic is measured with HP-8510B Network Analyzer (manufactured by Hewlett-Packard Company) as well. FIG. 20 illustrates the input power dependency of the insertion loss of the filter manufactured as described above at a temperature of the 20 kelvin. As seen in FIG. 20, the insertion loss is approximately 0.4 dB and does not change remarkably even with an input power of 41.8 dBm (approximately 15 W). Conventional high-frequency filters comprising a high temperature superconductor thin film can not function as a filter because superconductivity is lost when a high-frequency signal power of about 100 mW or larger is input. The high-frequency circuit element (filter) of the present invention has a structure which prohibits signal current concentration and withstands a large input power.

The above description is illustrative of this invention. Many changes and modifications may be made by those of ordinary skill in the art without departing from the scope of the appended claims.

We claim:

1. A high-frequency circuit element comprising a resonator having an elliptical-shaped conductor formed on a substrate, said resonator having two dipole modes orthogonally polarizing as resonant modes, and at least one input/output terminal coupled with said resonator on the circumference of said conductor with a gap formed between said conductor and said at least one input/output terminal.

2. The high-frequency circuit element as recited in claim 1, further comprising a structure selected from the group consisting of a microstrip line structure, a strip line structure and a coplanar wave guide structure.

3. The high-frequency circuit element recited in claim 2, further comprising a grounding electrode disposed on said substrate along the circumference of said conductor.

4. The high-frequency circuit element as recited in claim 1, wherein said conductor is a plate and said conductor is disposed between two grounded planes disposed parallel.

5. The high-frequency circuit element as recited in claim 1, wherein a superconductor is used as the conductor material.

6. The high-frequency circuit element as recited in claim 1, wherein two points at which only one of the two dipole modes of said resonant modes of said resonator polarizing orthogonally is excited on the circumference of said conductor are said input/output coupling points 1, 2, and input/output terminals are said resonator at said input/output coupling points 1, 2, respectively.

7. The high-frequency circuit element as recited in claim 1, wherein two points at which only one of the two dipole modes of said resonant modes of said resonator polarizing orthogonally is excited are said input/output coupling points, 1, 2, and two other different points at which only the other on of the two dipole modes is excited are said input/output coupling points 3, 4 on the circumference of said conductor, and input/output terminals are coupled with said resonator at said input/output bonding points 1–4 respectively.

8. The high-frequency circuit element as recited in claim 1, wherein two points at which both of the two dipole modes of said resonant modes of said resonator polarizing orthogonally are equally excited an which are located at neighboring positions on the circumference of said conductor are said input/output coupling points 1, 2, and said input/output terminals are coupled with said resonator at said input/output coupling points 1, 2, respectively.

9. The high-frequency circuit element as recited in claim 1, wherein two points at which both of the two dipole modes of said resonant modes of said resonator polarizing orthogonally are equally excited and which are located at facing positions on the circumference of said conductor are said input/output coupling points 1, 2, and said input/output terminals are coupled with said resonator at said input/output coupling points 1, 2, respectively.

10. The high-frequency circuit element as recited in claim 1, wherein a point at which both of the two dipole modes of said resonant modes of said resonator polarizing orthogonally are equally excited is said input/output coupling 1, a point at which only one of the dipole modes is excited is said input/output coupling point 2, a point at which only the other one of the dipole modes is excited is said input/output coupling point 3, and said input/output terminals are coupled with said resonator at said input/output coupling points 1–3, respectively.

11. The high-frequency circuit element as recited in claim 1, wherein said input/output terminal comprises a transmission line having two ends, and one end of said transmission line is coupled with said conductor comprising said resonator by capacitance coupling.

12. The high-frequency circuit element as recited in claim 11, wherein one end of said transmission line is coupled with capacitance by forming a gap between said end of said transmission line and the circumference of said conductor comprising said resonator.

13. The high-frequency circuit element as recited in claim 12, wherein one of said ends of the transmission line is widened.

14. The high-frequency circuit element as recited in claim 1, wherein a superconductor is used as the conductor material.

15. A high-frequency circuit element comprising a plurality of resonators, each of said resonators having an elliptical-shaded conductor formed on a substrate, and said resonators being coupled to each other with a gap.

16. The high-frequency circuit elements recited in claim 15, wherein two points at which both of the two dipole modes of said resonant modes of said resonator polarizing orthogonally are equally excited and which are located at neighboring positions are said input/output bonding points 1, 2, and said plurality of resonators are coupled in series at said input/output coupling points 1, 2, and at the coupling points of said resonators located at the ends of said plurality of resonators and not coupled with the neighboring resonator, two input/output terminals are coupled with said resonators at the ends of said plurality of resonators.

17. The high-frequency circuit element as recited in claim 15, wherein input/output terminals are comprised of transmission lines having two ends, and one end of each transmission line is coupled with said conductor comprising a resonator by capacitance coupling.

18. The high-frequency circuit element as recited in claim 17, wherein said ends of said transmission lines are coupled with capacitance by forming a gap between said end of said transmission line and the circumference of said conductor comprising said resonator.

19. The high-frequency circuit element as recited in claim 18, wherein one of said ends of said transmission lines is widened.

20. The high-frequency circuit element as recited in claim 15, wherein a superconductor is used as the conductor material.

* * * * *